US006209405B1

(12) United States Patent
Milsem

(10) Patent No.: US 6,209,405 B1
(45) Date of Patent: Apr. 3, 2001

(54) APPARATUS FOR TRANSFERRING A CARRIER FOR SHELVES, CUPBOARDS, TABLES OR THE LIKE ALONG A PATH

(76) Inventor: Stig Milsem, Fjelltorpvn. 12, N-1540 Vestby (NO)

( * ) Notice: Subject to any disclaimer, the term of this patent is extended or adjusted under 35 U.S.C. 154(b) by 0 days.

(21) Appl. No.: 08/973,904

(22) PCT Filed: Jun. 19, 1996

(86) PCT No.: PCT/NO96/00151

§ 371 Date: Dec. 17, 1997

§ 102(e) Date: Dec. 17, 1997

(87) PCT Pub. No.: WO97/00631

PCT Pub. Date: Jan. 9, 1997

(30) Foreign Application Priority Data

| | | |
|---|---|---|
| Jun. 22, 1995 | (NO) | 952502 |
| Feb. 20, 1996 | (NO) | 960662 |
| Feb. 27, 1996 | (NO) | 960792 |

(51) Int. Cl.[7] ..... F16H 21/16; A47B 51/00; A47F 3/06

(52) U.S. Cl. ..... 74/89.21; 108/138; 211/1.51; 248/284.1; 248/328; 312/266; 414/917

(58) Field of Search ..... 74/89.21, 89.22; 108/138; 211/1.51, 1.57; 248/284.1, 328, 329; 312/24, 27, 266; 414/917

(56) References Cited

U.S. PATENT DOCUMENTS

| | | | | |
|---|---|---|---|---|
| 3,528,304 | * | 9/1970 | Hopkins | 74/89.21 |
| 3,790,001 | * | 2/1974 | Schnell | 104/93 X |
| 4,360,187 | * | 11/1982 | Chapman | 254/8 R |
| 4,897,015 | * | 1/1990 | Abbe et al. | 414/744.8 |

FOREIGN PATENT DOCUMENTS

| | | |
|---|---|---|
| 1554464 | 9/1971 | (DE) . |
| 2306484 | 10/1974 | (DE) . |
| 2524406 | 12/1976 | (DE) . |
| 2721307 | 11/1978 | (DE) . |
| 2919610 | 11/1980 | (DE) . |
| 3215572 | 10/1983 | (DE) . |
| 3433137 | 3/1986 | (DE) . |
| 3635592 | 4/1988 | (DE) . |

(List continued on next page.)

*Primary Examiner*—Allan D. Herrmann
(74) *Attorney, Agent, or Firm*—Abelman, Frayne & Schwab

(57) ABSTRACT

A device for moving a support (2) for shelves (19), cupboards, tables or similar along a path, which support (2) is suspended in arm (1) that is pivotally connected to a base (9) about an axis of rotation (6) at one end of the arm (1), comprising:

a load transmission means (13), for example a cogwheel, at the axis of rotation (6), which is connected to the base (9), at least one rotating means (16), for example a cogwheel, pivotally mounted on the arm (1) spaced apart from the load transmission means (13), an elongate rotation transmission means (14), for example an endless chain, which extends at least from the load transmission means (13) to the rotating means (16), the rotating means (16) being connected to the support (2), so that when the arm (1) is turned about the axis of rotation (6) the load transmission means (13) transmits the relative rotational movement between the arm (1) and the load transmission means (13) via the rotation transmission means (14) to the rotating means (16), so that the position of the support (2) is controlled dependent upon the position of the arm (1). Thus, it is possible to hold, say, a shelf (19) or a cupboard in the same position relative to the vertical plane whilst it is being raised and lowered.

17 Claims, 6 Drawing Sheets

FOREIGN PATENT DOCUMENTS

| | | |
|---|---|---|
| 3731869 | 4/1988 | (DE) . |
| 3914307 | 10/1990 | (DE) . |
| 0242811 | 10/1987 | (EP) . |
| 0402283 | 12/1990 | (EP) . |
| 0661015 | 7/1995 | (EP) . |
| 2108374 | 5/1983 | (GB) . |
| 163162 | 4/1988 | (NO) . |
| WO9500055 | 1/1995 | (WO) . |

* cited by examiner

FIG. 4
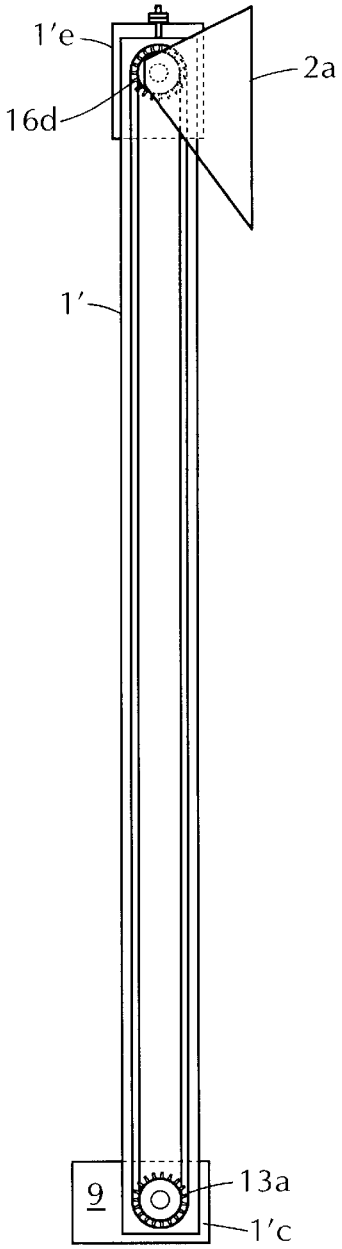
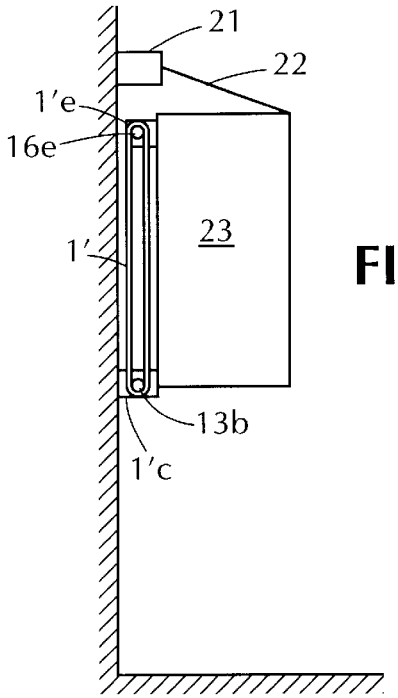
FIG. 5A
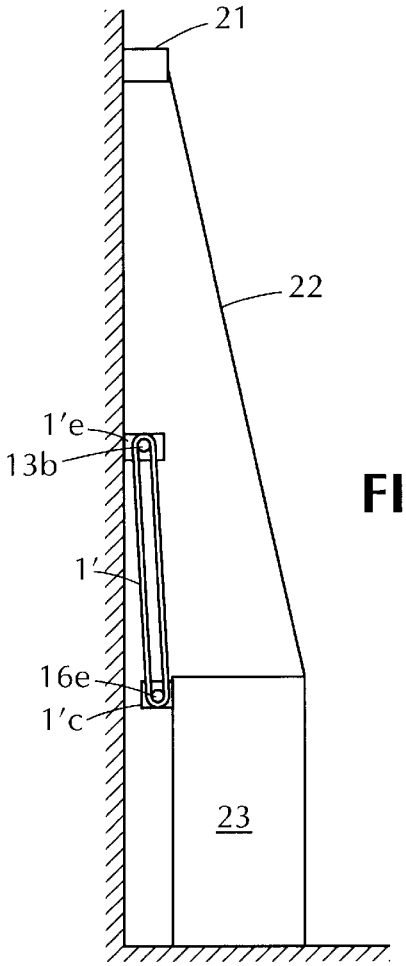
FIG. 5B

APPARATUS FOR TRANSFERRING A CARRIER FOR SHELVES, CUPBOARDS, TABLES OR THE LIKE ALONG A PATH

BACKGROUND OF THE INVENTION

1. Field of the Invention

The present invention relates to a device for moving a support for shelves, cupboards, tables or similar along a path, which support is suspended on an arm that is pivotally connected to a base, for example a wall, in an axis of rotation at one end of the arm.

2. Description of the Related Art

Devices of this type are used chiefly to lower shelves and cupboards from a position high up on a wall to a position lower down in order to facilitate access by disabled persons, for example, to articles placed high up. A typical area of application is the raising and lowering of shelves in an overhead cupboard in a kitchen.

A number of such devices are known. Reference shall be made, for example, to NO-163 162, DE-1 554 464, DE-3 215 572, DE-3 914 307, DE-2 721 307, EP 242811, EP 661015, EP 402283, DE-3 635 592, DE 2 919 610, DE-3 433 137 and DE-2 524 406. The devices according to these publications function for the most part either in that the cupboard or shelves are guided vertically, or in some cases slantwise, on rails or by means of arms of parallelogram configuration. These raising and lowering devices are set to guide the cupboard/shelves along a fixed path, which in the case of the rail-guided devices is a straight line, in the case of the devices which make use of arms of parallelogram configuration it is a circular arc. The path which the cupboard/shelves follow is fixed once and for all when the device is installed.

With the known devices it is not possible to lower an overhead cupboard below the level of the kitchen counter. Rail guides running on the outside of the kitchen counter would not be practical as these would prevent normal use of the kitchen counter. Nor do the parallelogram-guided devices provide any possibility of lowering, for example, an overhead cupboard below the kitchen counter. The lowering facility is limited by the length of arms, which in turn is limited by the height of the ceiling or the depth of the cupboard. For many disabled persons this may be insufficient to enable them to reach the top shelves in the overhead cupboard.

The raising and lowering devices, which function with the aid having a arms of parallelogram configuration, have arms consisting of several links, which inevitably results in a certain slack and above all the danger of the arms "scissoring" the wrong way when the arms assume a position parallel to or almost parallel to one another. A second problem with the parallelogram mechanism is that when the sides (the arms) of the parallelogram approach one another a great moment of force is exerted on the drive mechanism. The drive mechanism must therefore be dimensioned so as to be very strong or, alternatively, the moment of force must be compensated by means of weights or springs. Since the moment of force varies greatly depending upon the weight of the shelves, the weight or springs will not be able to compensate satisfactorily.

SUMMARY OF THE INVENTION

The objective of the present invention is to provide a device which allows the lowering of an overhead cupboard, for example, to a point below and optionally outside the plane of the kitchen counter and provides secure guiding of the cupboard/shelves without there arising any danger of the arms "scissoring" the wrong way or inadvertently "locking", and without the occurrence of any significant moment of force. This is achieved by means of a device having the characterising features hereinbelow.

BRIEF DESCRIPTION OF THE DRAWINGS

The invention will now be described in more detail with reference to the accompanying drawings, wherein:

FIG. 4 illustrates the device schematically according to the invention in a second embodiment;

FIGS. 5*a*–5*c* show the device schematically according to the second embodiment of the invention in three different positions.

DESCRIPTION OF THE PREFERRED EMBODIMENTS

Figure 1:
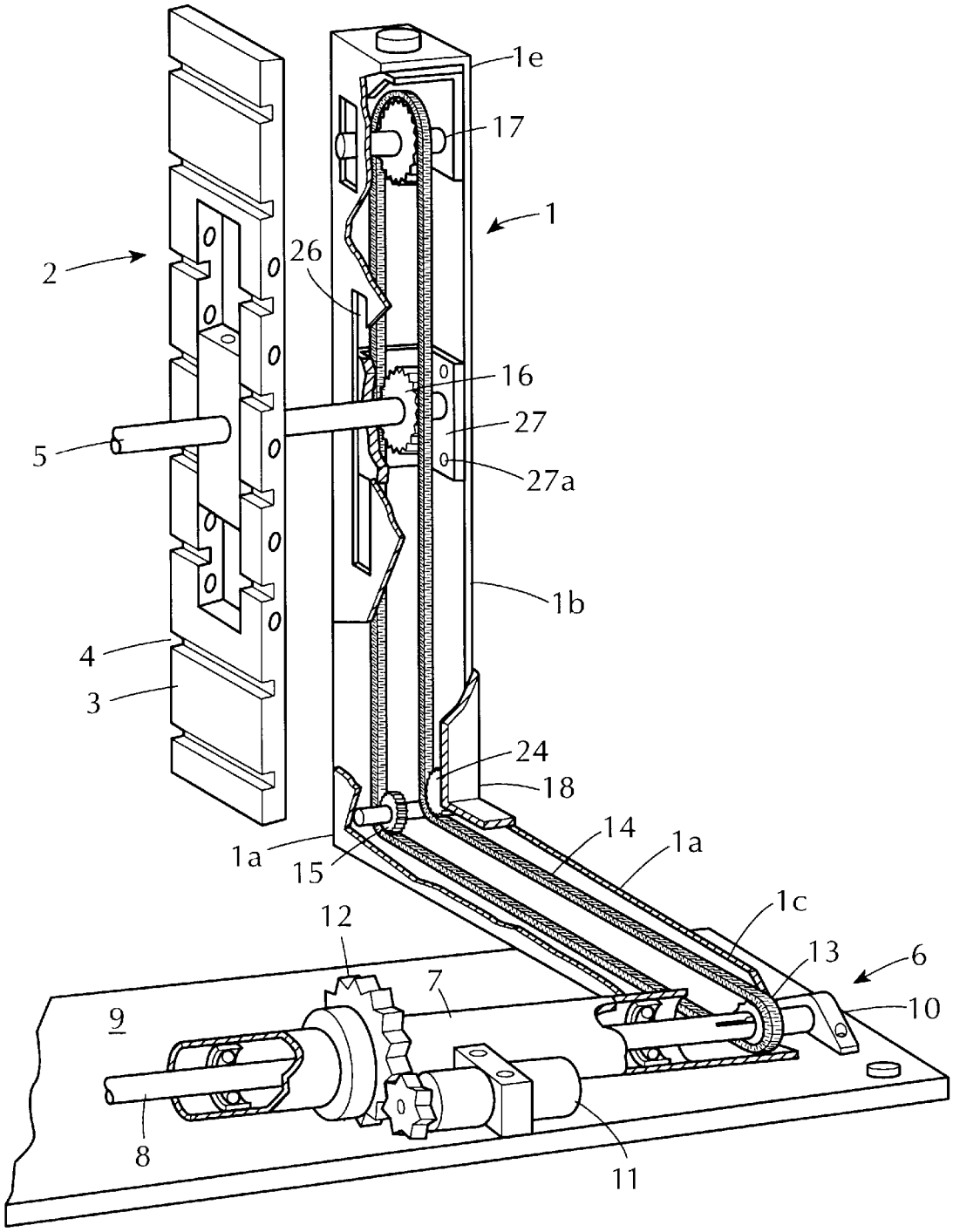
FIG. 1 illustrates a first embodiment of the invention in perspective and in detail.

FIG. 1 is a perspective view of the principal details of a first embodiment of the device according to the invention, shown partially in section. The device consists inter alia of a first arm 1 and optionally a second arm (not shown) spaced apart therefrom. A support 2, of which one half is shown in FIG. 1, is suspended between the first arm 1 and the second arm. The support 2 can be designed, for example, to support a number of shelves (not shown in FIG. 1), and for this purpose is equipped with a shelf supporting rail 3, wherein grooves 4 are formed for the insertion of shelves at different levels. The shelf supporting rail 3 is suspended in a support shaft 5 which extends between the first arm 1 and the second arm. The first arm 1 and the second arm may be constructed so as to be identical, but do not necessarily need to be so, as the mechanism which will be described below only needs to be provided in the first arm 1. In this case, the second arm will function as a "slave" and follow the movement of the first arm.

In the first arm 1, a mechanism is provided which ensures, for example, that the shelves maintain the right position when the arm 1 is swung outwards and downwards. The arm 1 is thus mounted about an axis of rotation 6. This can be done, for example as is shown in FIG. 1, in that the arm is fixedly connected to a sleeve shaft 7 which is rotatably mounted on a shaft 8, which in turn is fixedly connected to a base 9, for example a cupboard bottom, via brackets 10. In order to turn the arm there may be provided, for example, an electric motor 11 which, via a cogwheel 12, is designed to rotate the sleeve shaft 7 and thereby turn the arm 7 about the axis of rotation 6.

A cogwheel 13 is fixedly connected to the shaft 8 and thus is in a non-moveable relation to the base 9. Over the cogwheel 13 there extends an endless chain 14 which, as can be seen in FIG. 1, may be positioned inside a cavity in the arm 1 and extend the length thereof. Via a redirectioning wheel 15, the chain 14 extends along the arm up to a cogwheel 16, which is fixedly connected to the shaft 5. The chain 14 extends further over a reversing wheel 17, equipped with a tensioning device to tension the chain 14, and back to the cogwheel 13 via a redirecting member 24 (i.e. sprocket, or optionally a fixed arcuate member) at the bend or 18 of the arm 1.

The support 2 is slideably mounted with respect to arm 1 as shown, in such a way that the cogwheel 16 and the shaft 5 can be displaced along the arm. For this purpose a slot 26 is formed in the arm 1. Shaft 5 can be displaced along arm 1 by disconnecting plate 27 which is rotatably attached thereto, moving chain 14 out of mesh with cogwheel 16, and sliding shaft 5 and plate 27 to a different position along arm 1. Plate 27 may be releasably attached to arm 1 by known means such as bolts (not shown) positioned in bolt holes 27*a* or alternative releasable fasteners. After sliding shaft 5 and plate 27 to a different position, reattachment of plate 27 to arm 1 can also be provided in any known manner, as by providing a plurality of bolt holes or slots in arm 1 for reception of bolts, screws or the like. The shelf supporting rail 3 may also be slideably mounted on the shaft 5.

Figure 2A:
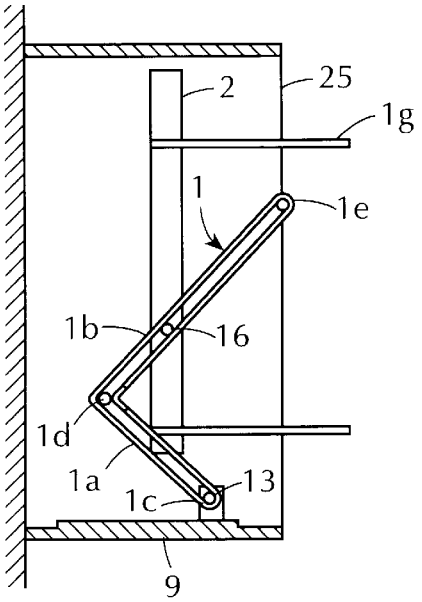
FIGS. 2*a*–2*d* show the device schematically according to a first embodiment of the invention in four different positions.

In FIGS. 2*a*–2*d* the function of the arm is shown, where FIG. 2*a* shows the arm 1 having been turned a little forward from a starting position where the arm is turned right back to the left in FIG. 2*a* and is inside a cupboard 25. Since the cogwheel 13 is non-rotationally connected to the base 9 the chain 14 will be retained by the cogwheel 13. The movement of the arm 1 will thereby be transmitted via the cogwheel 13 to the cogwheel 16 and cause this to be retained in the same rotational position relative to the cogwheel 13 and the base 9, i.e., the cogwheel 16 will not rotate about its axis. Thus, the support 2 is also held in the same position relative to the vertical plane when the arm 1 moves forwards and downwards.

Figure 2B:
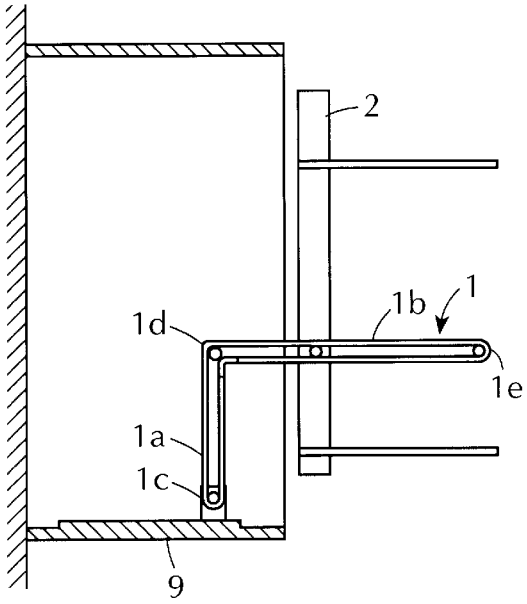
Figure 2C:
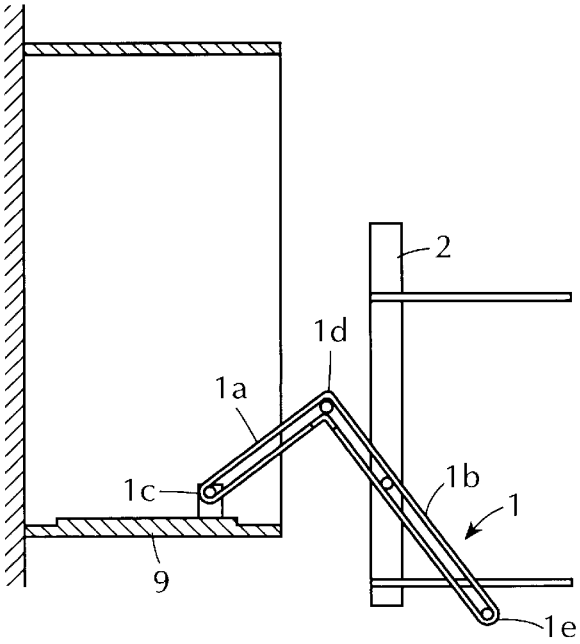
Figure 2D:
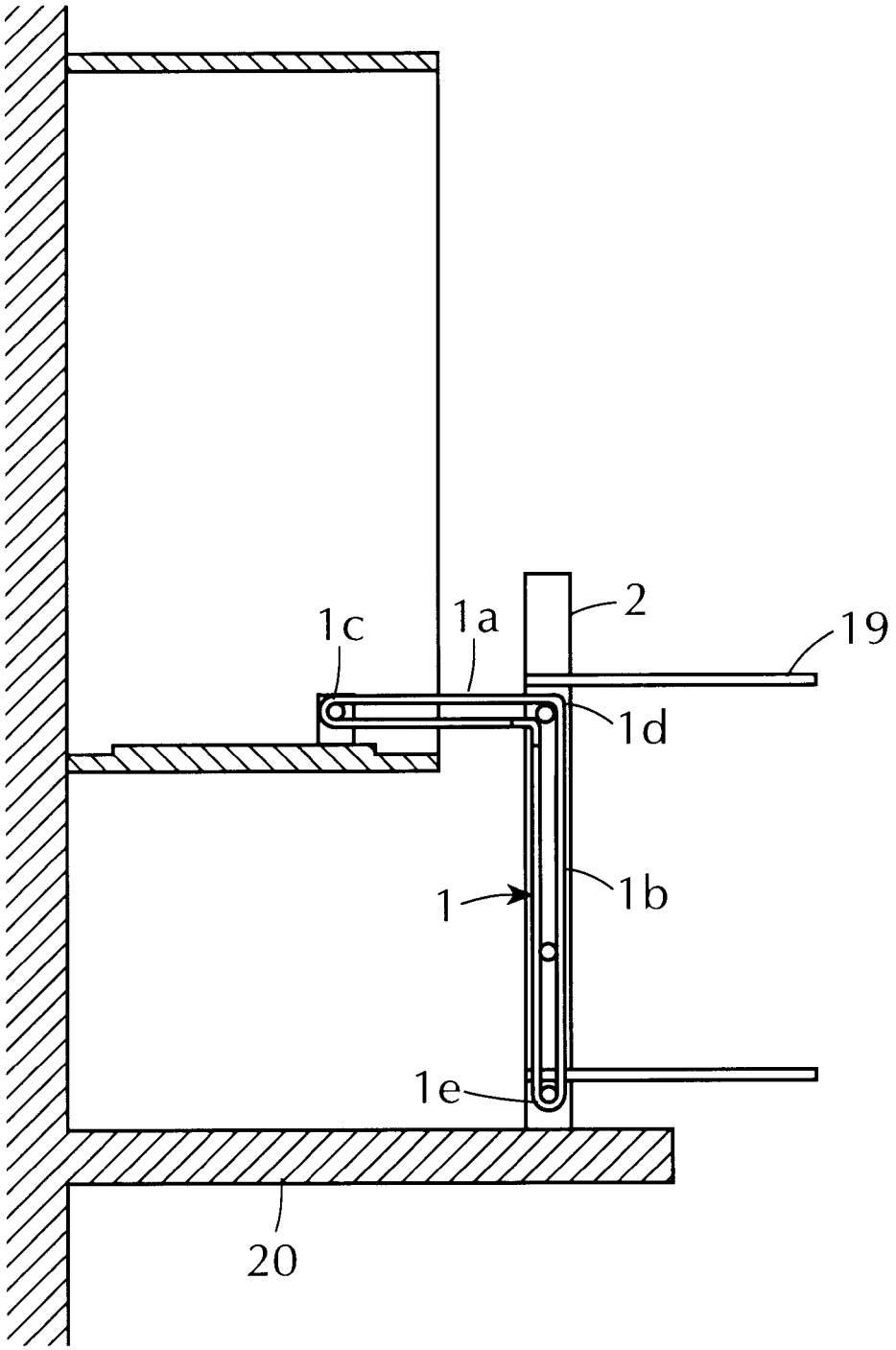
Figure 3A:
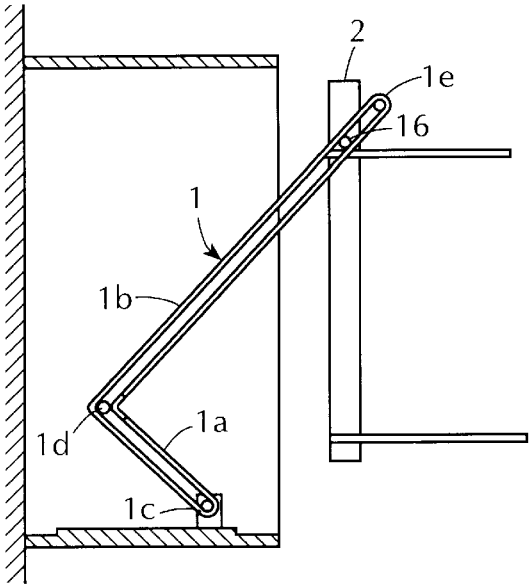
FIGS. 3*a* and 3*b* show the device schematically according to the first embodiment of the invention adjusted for greater lowering height.
Figure 3B:
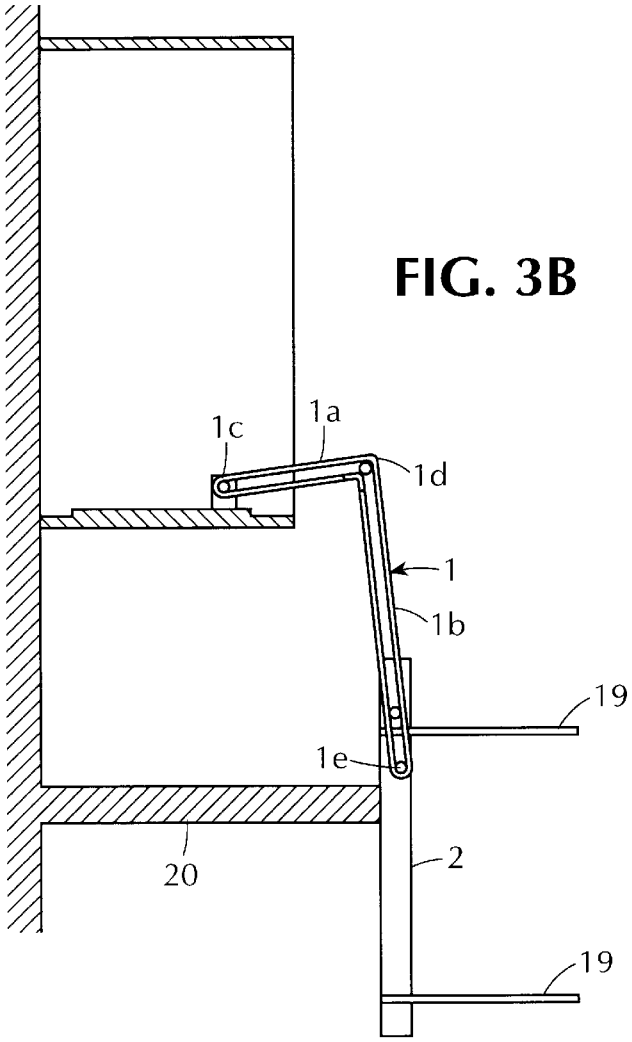

In FIG. 2*b* the arm 1 has moved outwards so that the upper part of the arm I is now horizontal. The support 2 has now moved a small distance outwards but vertically to an insignificant degree. In FIG. 2*c* the arm 1 has moved quite some distance downwards and the support 2 has moved likewise. In FIG. 2*d* the outermost part of the arm 1 is pointing vertically downwards, and the support 2 is now positioned considerably lower than in the starting position. However it is still vertical, so that the shelves are held in a horizontal position. In the case illustrated in FIG. 2*d* the support 2 has been lowered so that its lower end rests on a counter surface 20. However, it is also possible to lower the support 2 so that its lower end comes to rest some distance below and thus also outside the counter surface 20. This is shown in FIGS. 3*a* and 3*b*. Here, the cogwheel 16 has been displaced along the arm 1 towards the free end thereof. In practice, this is done by slackening the chain 14 so that it can be brought out of mesh with the cogwheel 16, thereby enabling the cogwheel 16 to be displaced in the slot 26. At the same time, the support 2 is lowered relative to the cogwheel 16 in that the shelf supporting rail is lowered relative to the shaft 5, so that the upper end of the support assumes approximately the same height when the arm 1 is in the starting position as is the case in the situation in FIGS. 2*a*–2*d*. However, when, on the other hand, the arm 1 is swung out and down to the position shown in FIG. 3*b*, the support 2 will depend from the arm 1 to a far greater extent than in the situation shown in FIG. 2*d*. In this way the shelves 19 will be capable of being positioned outside and below the counter surface 20.

In FIG. 4 a second embodiment of the device according to the invention is shown. Here, the arm is not L-shaped but straight. The cogwheel 13 in FIG. 4 corresponds to the cogwheel 13 in the preceding embodiment. It is also fixedly connected to a base 9. However, in this case the support 2*a* is connected to a cogwheel 16*d* at the free end of the arm 1*a* opposite the cogwheel 13*a*. The cogwheel 16*d* here has the same function as the cogwheel 16 in the preceding embodiment and also the function of the reversing wheel 17.

Figure 5C:
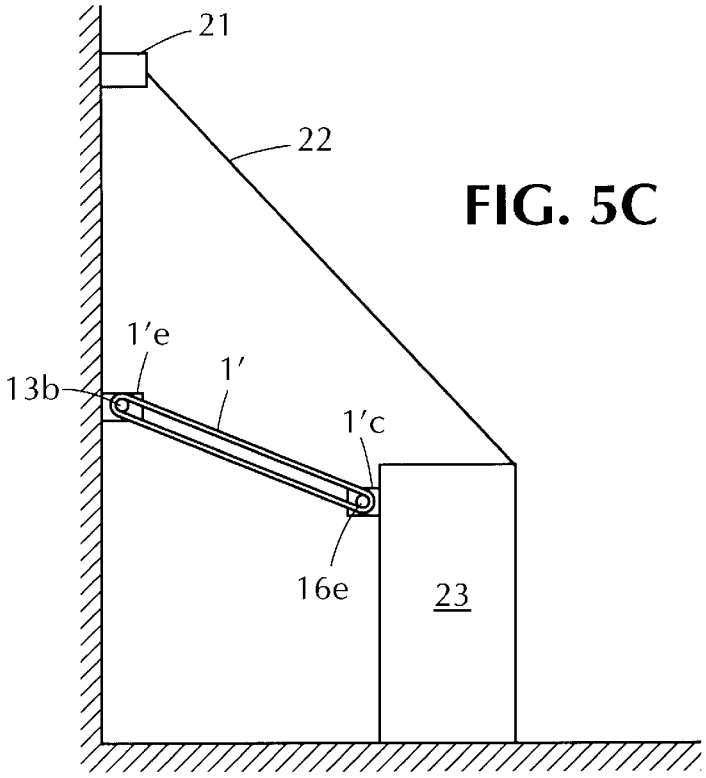

This embodiment is best suited for lowering whole cupboards down from a high position on a wall. Here, instead of the operation of the arm 1*a* at its axis of rotation, a motor 21 is provided secured to the wall above the axis of rotation, and preferably also above the free end of the arm 1*a*, whence a wire 22 extends down to the front edge of the cupboard. This is shown in FIGS. 5*a*–5*c*. In FIG. 5*a* the arm 1 is in the starting position. When the wire 22 is slackened the cupboard 23 will be lowered towards the floor. Since the cogwheel 16*e*, which is fixedly connected to the cupboard 23, cannot rotate relative to the cogwheel 13*a* and thus also the wall, the cupboard 23 will be held in the same orientation relative to the wall whilst it is being lowered. In FIG. 5*b* the cupboard 23 is lowered down to the floor approximately immediately below the position it had on the wall in the starting position. However, in FIG. 5*c* the axis of rotation of the arm 1 is located at a lower point so that the cupboard comes to rest further out from the wall in its lowered position. This makes it possible to lower the cupboard outside a table or another cupboard (not shown) positioned on the floor against the wall.

Figure 6:
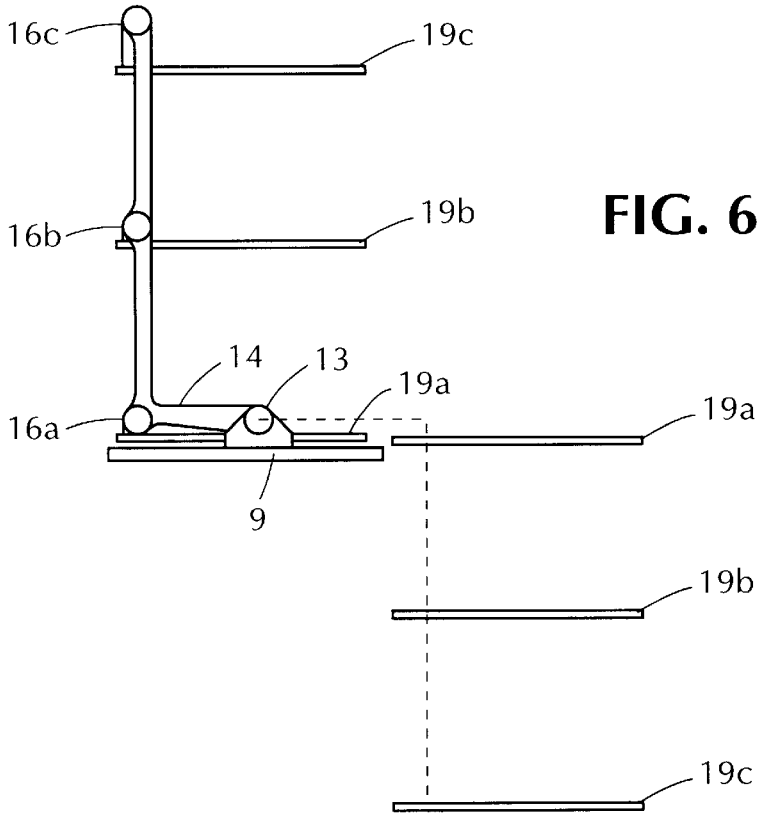
FIG. 6 shows a third embodiment of the invention schematically presented in two different positions.

In FIG. 6 a third embodiment of the device according to the invention is shown, where three cogwheels 16*a*, 16*b* and 16*c* are in mesh with the chain 14, which in turn is in mesh with the cogwheel 13, which here too is fixedly connected to the base 9. Thus, the cogwheels 16*a*, 16*b* and 16*c* will not be able to rotate relative to the cogwheel 13. When the arm, which is not shown here in order to facilitate understanding of the drawing, is lowered to the position which is indicated by means of the broken line on FIG. 6, the shelves 19*a*, 19*b* and 19*c* will have changed places with one another. Nevertheless, throughout the movement of the arm they will be held in a horizontal position.

Although in the above embodiments of the invention have been described where an endless chain is used to retain the rotation of the cogwheel 16 relative to the cogwheel 13, other means may also conceivably be used to transmit these loads. Belts, straps, tapes and similar are obvious. Within the scope of the invention, however, there is also a possibility of using shafts having conical cogwheels at each end. The cogwheels 13 and 16 must then, of course, also be conical. By arranging the cogwheel 16 slideably on the shaft, this embodiment will provide the same possibilities for adjustment as if a chain or similar were being used.

Although in the above embodiments have been shown where the support is held in the same position relative to the vertical plane during the movement of the arm, it is also within the scope of the invention to be able to alter this position during the movement of the arm. This can be done, for example, by providing a gear between the cogwheel 13 and 16 which is different from one to one. It is also possible to arrange the cogwheel 13 so that it is capable of being rotated relative to the base 9, e.g., with the aid of a motor, so that by turning the cogwheel 13 the cogwheel 16 is caused to turn, resulting in an alteration of the position of the support 2. Other modifications are also conceivable within the scope of the patent claims below, and in particular independent patent claim 1 below.

What is claimed is:

1. A device for moving an article selected from the group consisting of: at least one shelf, a cupboard, and a table, along a predetermined path, the device comprising:

a) a support member (2), to which the selected article is fixedly attached in a predetermined orientation;

b) an arm (1), having a proximal first end (1*a*) and a distal second end (1*b*), with at least one elongate portion therebetween, and an axis of rotation (6) at the proximal end, such that the support member (2) is rotationally attached to the arm (1), the arm (1) being for moving the support member (2) and the attached article, about the axis of rotation (6), from a first position, wherein the support member (2) and the attached item are elevated and/or recessed, through a plurality of intermediate positions of at least partial extension and/or lowering of the support member (2) and the attached article, to a final position, wherein the support member (2) and the attached article are extended and/or lowered;

c) a base member (9), to which the arm (1) is pivotally attached about its proximal end (1*a*);

d) load transmission means (13), located at the axis of rotation (6) and fixedly attached to the base member (9), the axis of rotation (6) being parallel to the base member (9);

e) rotating means (16), pivotally mounted on the arm (1) and spaced apart from the load transmission means (13), for rotating the support member (2) and the attached article; and f) an elongate rotation transmission means (14) extending at least from the load transmission means a to the rotating means (16) to transfer relative rotational movement from the load transmission means (13) and the arm (1) to the rotating means;

the rotating means (16) being operatively fixedly connected to the support member (2), such that when the load transmission means (13) is operative to pivotally rotate the arm (1) about the axis of rotation (6) in a first direction, the rotating means (16) rotates in a second, opposite direction to maintain the predetermined orientation of the support member (2) and attached item, thereby causing movement of the support member along an arcuate path, alternatively in forward and reverse directions, dependent upon the rotational direction provided by the load transmission means (13).

2. The device according to claim 1, wherein the a arm (1) is L-shaped, having first and second elongate portions (1*a*, 1*b*), such that the first elongate portion (1*a*) terminates at the proximal end (1*c*) of the arm (1) that is pivotally attached to the base member (9), and the second elongate portion (1*b*) is perpendicular to the first elongate portion (1*a*), such that an angular bend (1*d*) is formed between the first and second elongate portions, with the second elongate portion (1*b*) terminating at the distal end (1*e*) of the arm (1), and the device further comprising redirecting means (15) for redirecting the direction of the elongate rotation transmission means (14) from a direction parallel to the first elongate portion (1*a*) of the arm (1) to a direction perpendicular thereto and parallel to the second elongate portion (1*b*) of the arm (1), the elongate rotation transmission means (14) extending from the load transmission means (13) to the rotating means (16) through the redirecting means (15), the redirecting means (15) being mounted in the bend (1*d*) of the L-shaped arm (1).

3. The device according to claim 2, wherein the rotation transmission means (14) is an endless element selected from the group consisting of a chain and a belt, the load transmission means the redirecting means (15) and the rotating means (16) are elements selected from the group consisting of cogwheels a pulleys, and the device further comprises a reversing wheel (17), rotationally attached to the second elongate portion (1*b*) of the arm (1) proximate to the distal end (1*e*) of the arm (1), the reversing wheel (17) being for returning the endless rotation transmission means (14) to the load transmission means (13), the rotation transmission means (14) being redirected over the redirecting means.

4. The device according to claim 1, wherein the arm (1') is straight, having a single elongate portion (1'*a*), a proximal end (1'*c*), and a distal end (1'*e*), with the load transmission means (13) being positioned at the proximal end (1'*c*) of the arm (1'), and the rotating means (16) being positioned at the distal end (1'*e*) of the arm (1').

5. The device according to claim 4, wherein wire means (22) extends from an element selected from the group consisting of the distal end (1'*e*) of the arm (1'), the support member (2), and an article fixedly attached to the support member (2), to a fixed point above the axis of rotation (6), the wire means (22) being adapted to raise and lower the distal end (1'*e*) of the arm (1') relative to the axis of rotation (6) when the wire means (22) is respectively drawn in or paid out.

6. The device according to claim 1, further comprising a shaft (8), the load transmission means (13) a being fixedly connected to the shaft (8), the shaft (8) being fixedly connected to the base member (9), a sleeve shaft (7), extending concentrically with the shaft (8) and being fixedly connected to the arm (1), and drive means (11), coupled to the sleeve shaft (7).

7. The device according to claim 1, wherein the load transmission means (13) and the rotating means a have different gearing so that the orientation of the support member (2) relative to a vertical plane or a horizontal plane, is altered when the arm (1) is turned about the axis of rotation (6).

8. The device according to claim 1, wherein a plurality of rotating means (16) are arranged spaced apart from one another along the arm (1), the rotating means (16) each being in mesh with the elongate rotation transmission means (14) so that each the rotating means independently is rotationally dependent upon the load transmission means (13) and each is connected to its respective support (2).

9. The device according to claim 1, wherein the rotating means (16) is arranged so as to be movable along the arm (1), and the support (2) is arranged so as to be moveable relative to the rotating means (16).

10. The device according to claim 1, containing a second arm (1"), spaced apart from the first arm (1).

11. The device according to claim 10, wherein the second arm (1") is an oppositely paired copy of the first arm (1) that includes a corresponding set of actuation elements (d'), (e'), and (f'), associated with the second arm (1"), corresponding to actuation elements (d), (e), and (f) associated with the first arm (1).

12. The device according to claim 10, wherein the second arm (1") is an oppositely paired copy of the first arm (1), but does not include a corresponding set of actuation elements associated with the second arm (1"), corresponding to actuation elements (d), (e), and (f) associated with the first arm, such that the second arm (1") operates in a slave mode and has its movement determined by the movement of the first arm (1).

13. The device according to claim 1, wherein the article is a plurality of shelves (19) and the supporting member (2) further includes a shelf supporting rail (3), containing a plurality of grooves (4), corresponding to the plurality of shelves (19), such that each groove is at a different level to support a corresponding shelf (19) at each level.

14. The device according to claim 1, wherein the rotation transmission means (14) is a shaft having a conical cogwheel at each opposite end, and wherein the load transmission means (13) and the rotating means (16) are conical cogwheels, such that the conical cogwheel rotating means (16) is slideably disposed on the rotation transmission shaft (14).

15. The device according to claim 4, wherein the rotation transmission means (14) is an endless element selected from the group consisting of a chain and a belt, and the rotating means (16) also functions as a reversing wheel (17) to return the endless rotation transmission means (14) to the load transmission means (13).

16. A device for moving a support member for an article selected from the group consisting of at least one shelf, a cupboard, and a table, along a predetermined path, the device comprising:

a) an L-shaped arm (1), having first and second ends with first and second elongate portions therebetween, such that the first and second elongate portions are perpendicular to one another forming an "L" shape, the arm (1) further having an axis of rotation (6) at one end, the arm (1) being pivotally connected to a base member (9), such that the arm (1) moves the support member about the axis of rotation (6), from a first position, wherein the support member is elevated and/or recessed, through a plurality of intermediate positions of at least partial extension and/or lowering of the support member, to a final position, wherein the support member is extended and/or lowered;

b) load transmission means (13) located proximate to the axis of rotation (6) and fixedly connected to the base member (9), the axis of rotation (6) being substantially parallel to the base member (9);

c) rotating means (16), pivotally mounted on the arm (1) and spaced apart from the load transmission means (13); and d) an elongate rotation transmission means (14) extending at least from the load transmission means (13) to the rotating means (16) to transfer relative rotational movement from the load transmission means (13) and the arm (1) to the rotating means (16);

the rotating means being operatively fixedly connected to the support member such that when the load transmission means (13) is operative to pivotally rotate the arm (1) about the axis of rotation (6) in a first direction, the rotating means (16) rotates in the opposite direction to maintain the predetermined orientation of the support member, thereby causing movement of the support member along a curved path in predetermined forward and reverse directions dependent upon the rotational direction provided by the load transmission means (13).

17. A device for moving a support member for an article selected from the group consisting of at least one shelf, a cupboard, and a table, along a predetermined path, wherein a generally L-shaped arm (1) is pivotally connected to a base member and adapted to suspend the support member about an axis of rotation located at one end of the arm, the device comprising:

a) load transmission means (13) located generally at the axis of rotation (6) and fixedly connected to the base member (9), the axis of rotation (6) being substantially parallel to the base member (6);

b) a motor (11), operationally connected to rotate the arm (1);

c) rotating means (16), pivotally mounted on the arm (1) and spaced apart from the load transmission means; and e) an elongate rotation transmission means (14), extending at least from the load transmission means (14) to the rotating means (16) to transfer relative rotational movement from the load transmission means (13) and the arm (1) to the rotating means (16), the elongate rotation transmission means (14) extending from the load transmission means to the rotating means (16) through redirecting means (15) mounted in the knee of the L-shaped arm;

the rotating means (16) being operatively fixedly connected to the support member, such that when the load transmission means (13) is operative to pivotally rotate the arm (1) about the axis of rotation in a first direction, the rotating means (16) rotates in the opposite direction to maintain the predetermined orientation of the support member, thereby causing movement of the support member along a curved path in predetermined forward and reverse directions dependent upon the rotational direction provided by the load transmission means (13).

* * * * *